US009039248B2

(12) United States Patent
Kajiwara et al.

(10) Patent No.: US 9,039,248 B2
(45) Date of Patent: May 26, 2015

(54) ILLUMINATING APPARATUS

(75) Inventors: Yasushi Kajiwara, Saitama (JP); Masato Nakamura, Saitama (JP)

(73) Assignee: ENPLAS Corporation, Saitama (JP)

( * ) Notice: Subject to any disclaimer, the term of this patent is extended or adjusted under 35 U.S.C. 154(b) by 0 days.

(21) Appl. No.: 14/131,936

(22) PCT Filed: Jun. 28, 2012

(86) PCT No.: PCT/JP2012/004205

§ 371 (c)(1),
(2), (4) Date: Jan. 10, 2014

(87) PCT Pub. No.: WO2013/008400

PCT Pub. Date: Jan. 17, 2013

(65) Prior Publication Data

US 2014/0168996 A1 Jun. 19, 2014

(30) Foreign Application Priority Data

Jul. 12, 2011 (JP) ..... 2011-154354

(51) Int. Cl.

| | |
|---|---|
| ***F21V 3/00*** | (2006.01) |
| ***F21K 99/00*** | (2010.01) |
| ***F21V 5/04*** | (2006.01) |
| ***F21V 17/12*** | (2006.01) |
| ***F21V 17/16*** | (2006.01) |
| ***F21S 8/10*** | (2006.01) |
| *F21V 7/00* | (2006.01) |
| *F21Y 101/02* | (2006.01) |

(52) U.S. Cl.

CPC ... *F21K 9/50* (2013.01); *F21V 5/04* (2013.01); *F21V 7/0091* (2013.01); *F21V 17/12* (2013.01); *F21V 17/164* (2013.01); *F21Y 2101/02* (2013.01); *F21S 48/115* (2013.01); *F21S 48/1208* (2013.01); *F21S 48/1225* (2013.01); *F21S 48/215* (2013.01); *F21S 48/2206* (2013.01); *F21S 48/2212* (2013.01)

(58) Field of Classification Search

CPC ..... F21V 5/04
USPC ..... 362/235, 311.02
See application file for complete search history.

(56) References Cited

U.S. PATENT DOCUMENTS

| | | | | |
|---|---|---|---|---|
| 2010/0002450 | A1* | 1/2010 | Pachler et al. | 362/311.02 |
| 2010/0118550 | A1* | 5/2010 | Kuo | 362/311.02 |
| 2010/0238669 | A1* | 9/2010 | Holder et al. | 362/311.02 |
| 2013/0128576 | A1 | 5/2013 | Seki et al. | |

FOREIGN PATENT DOCUMENTS

| | | | |
|---|---|---|---|
| JP | 3115370 | U | 11/2005 |
| JP | 2007-220465 | A | 8/2007 |
| JP | 2007-266242 | A | 10/2007 |
| WO | 2012-017636 | A1 | 2/2012 |

* cited by examiner

*Primary Examiner* — Evan Dzierzynski
(74) *Attorney, Agent, or Firm* — Brundidge & Stanger, P.C.

(57) ABSTRACT

A lens holder (6) has: a lens holding section (21), which elastically holds a flange (17) of a lens (5); a section to be pressed (22), which is positioned to surround the lens holding section (21), and is fixed to a substrate (3) by being pressed to the substrate by means of a holder fixing means (2); and connecting sections (23, 24), which partially connect to each other the lens holding section (21) and the section to be pressed (22). The height of the section to be pressed (22) from the substrate (3) is more than the height of the lens holding section (21) from the substrate (3), and the lens holding section (21) is not in contact with the holder fixing means (2).

1 Claim, 11 Drawing Sheets

ILLUMINATING APPARATUS

TECHNICAL FIELD

The present invention relates to an illuminating apparatus in which an LED package is used as a light source.

BACKGROUND ART

In the related art, as illustrated in FIG. 11, illuminating apparatus 100 configured to emit light from LED chip 102 mounted on substrate 101 through lens 103 is known. In illuminating apparatus 100, flange 104 of lens 103 is fitted into flange fitting groove 106 of lens holder 105 and lens 103 is held over substrate 101 by lens holder 105. In illuminating apparatus 100, lens holder 105 is fastened to substrate 101 with screw 108 through decorative plate 107 (see PTL 1).

CITATION LIST

Patent Literature

PTL 1

Japanese Patent Application Laid-Open No. 2007-220465

SUMMARY OF INVENTION

Technical Problem

However, as illustrated in FIG. 11, in illuminating apparatus 100 of the related art, a fastening force of the screw easily causes a strain in an emission surface of lens 103 through lens holder 105 and there is a concern that the positional relationship between lens 103 and LED chip 102 may deviate from the designed positional relationship. Thus, in illuminating apparatus 100 of the related art, there is a problem that optical performance is likely to be decreased by the fastening force of the screw.

As illustrated in FIG. 11, in illuminating apparatus 100 of the related art, where a gap between lens 103 and substrate 101 or LED chip 102 is designed to be very small in order to increase use efficiency of the light from LED chip 102, if lens holder 105 is deformed by the fastening force of the screw, lens 103 may hit against substrate 101 or LED chip 102 and there is a concern that lens 103, substrate 101 or LED chip 102 may be damaged. In particular, when illuminating apparatus 100 is used in a portion on which the vibration of a vehicle or the like acts, there is a problem that noise may occur from minute collisions between lens 103 and substrate 101 or LED chip 102 due to the vibration, or from friction between lens 103 and substrate 101 or LED chip 102 due to the vibration.

Thus, an object of the present invention is to solve the problem of the illuminating apparatus of the related art.

Solution to Problem

As illustrated in FIGS. 1A, 1B, 2A, 2B, 6A, 6B, 7A, 7B, 8A, 8B, 9A, 9B, 10A, 10B and 10C, the invention of claim 1 relates to illuminating apparatus 1 including: LED package 4 mounted on substrate 3; lens 5 that is disposed so as to oppose LED package 4 and through which light from LED package 4 is transmitted; lens holder 6 that supports lens 5 over substrate 3 with lens 5 being positioned with respect to LED package 4; and holder fixing section 2 that fixes lens holder 6 to substrate 3 by pressing lens holder 6 thereto. In the invention, lens 5

- has ring-shaped flange 17 about lens central axis L1 along an outer periphery thereof, and
- is supported by lens holder 6 so that lens central axis L1 is concentric with optical axis L0, optical axis L0 defined as a direction where center light of a three-dimensional light flux emitted from LED package 4 propagates, and lens holder 6

- has lens holding section 21 supporting flange 17 of lens 5, sections to be pressed 22 and 36 being positioned further away from lens central axis L1 than lens holding section 21, being positioned so as to surround lens holding section 21 and being pressed toward substrate 3 by holder fixing section 2, and connecting sections 23, 24 and 37 partially connecting lens holding section 21 and sections to be pressed 22 and 36,
- is configured such that heights of sections to be pressed 22 and 36 from substrate 3 are greater than a height of lens holding section 21 from substrate 3, and lens holding section 21 does not come into contact with holder fixing section 2, and
- is configured such that lens holding section 21 and a part of sections to be pressed 22 and 36 are connected to each other by connecting sections 23, 24 and 37, so that when sections to be pressed 22 and 36 are pressed by holder fixing section 2, deformation of sections to be pressed 22 and 36 does not affect lens holding section 21.

Advantageous Effects of Invention

In the illuminating apparatus of the present invention, since the fastening force of the holder fixing section does not directly act on the lens holding section which holds the lens and it is possible to suppress deformation of the lens due to the lens holder, decrease in the optical performance does not occur.

Furthermore, in the illuminating apparatus of the present invention, since the deformation of the section to be pressed of the lens holder on which the fastening force of the holder fixing section acts does not adversely affect support accuracy of lens holding section of the lens holder to the lens, and it is possible to suppress occurrence of the deviation in the positional relationship from the designed positional relationship between the lens and the LED package, the decrease in the optical performance does not occur.

Furthermore, in the illuminating apparatus of the present invention, even though the gap between the lens and the LED package is designed to be very small in order to increase the light use efficiency of the light from the LED package, it is possible to prevent the lens holding section of the lens holder elastically supporting the lens from being deformed by the fastening force of the holder fixing section and then the lens can be held with high accuracy using the lens holding section of the lens holder. Thus, in the illuminating apparatus of the invention, the gap between the lens and the LED package is reliably maintained, the lens does not hit against the LED package, and the lens or the LED package is not damaged.

Furthermore, in the illuminating apparatus of the present invention, the gap between the lens and the LED package is reliably maintained even though the illuminating apparatus is used in a portion on which the vibration of a vehicle or the like acts. Thus, in the illuminating apparatus of the present invention, it is possible to prevent occurrence of noise due to the vibration without minute collisions between the lens and the LED package due to the vibration, or friction between the lens and the LED package due to the vibration.

DESCRIPTION OF EMBODIMENTS

Hereinafter, embodiments of the present invention will be described with reference to the drawings.

Embodiment 1

Figure 1A:
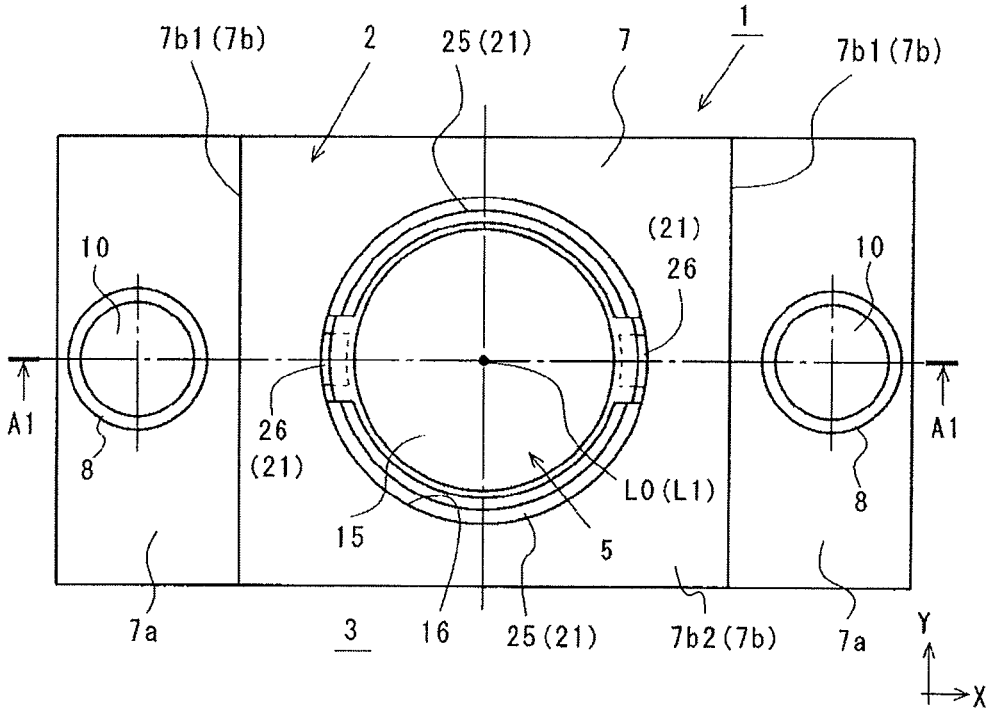
FIG. 1A is a plan view of an illuminating apparatus according to Embodiment 1 of the present invention and FIG. 1B is a cross-sectional view of the illuminating apparatus cut along line A1-A1 in FIG. 1A.
Figure 1B:
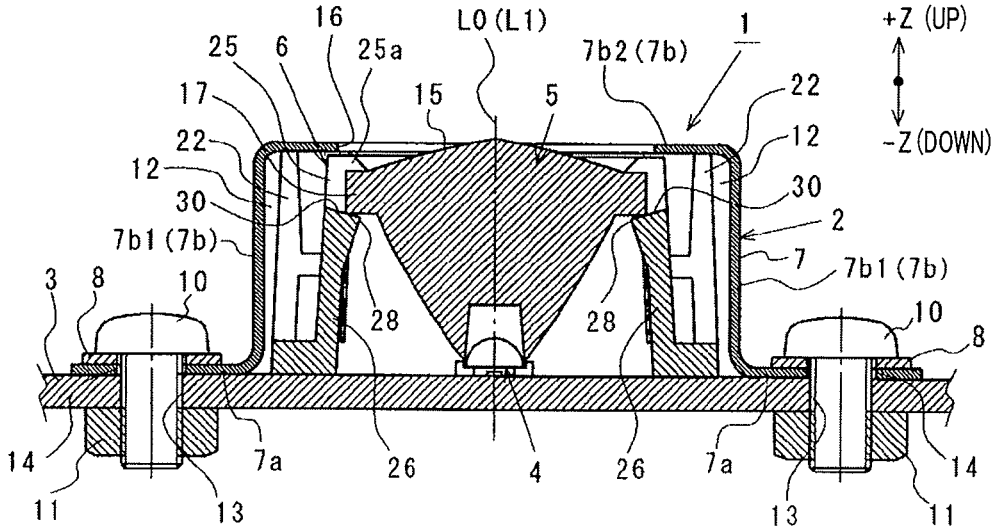
Figure 2A:
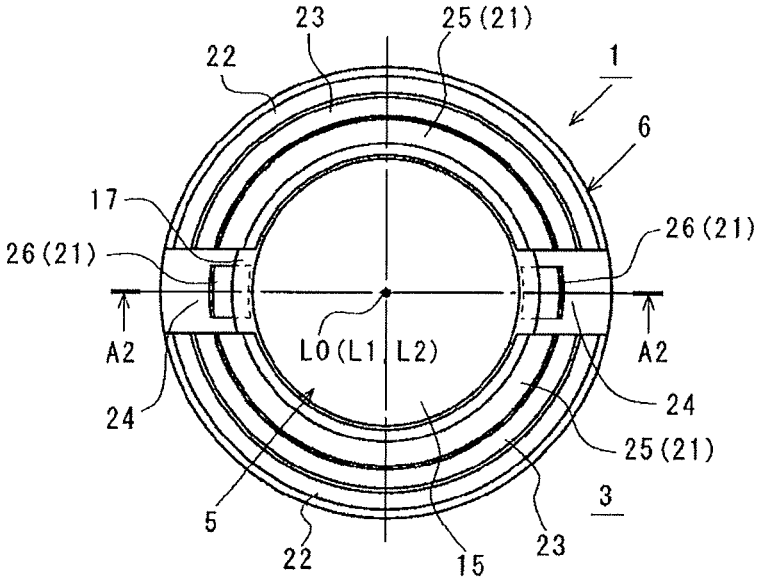
FIG. 2A is a plan view illustrating the illuminating apparatus illustrated in FIG. 1A without a holder fixing section and FIG. 2B is a cross-sectional view of the illuminating apparatus cut along line A2-A2 in FIG. 2A.
Figure 2B:
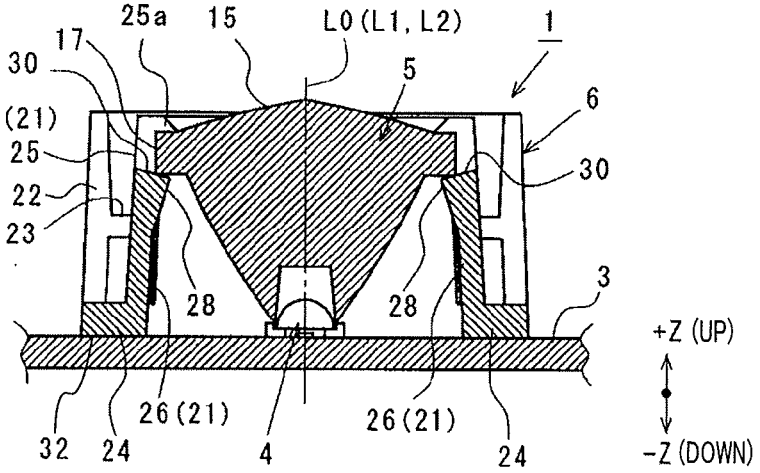

FIGS. 1A, 1B, 2A and 2B illustrate illuminating apparatus 1 according to Embodiment 1 of the present invention. FIG. 1A is a plan view of illuminating apparatus 1. FIG. 1B is a cross-sectional view of illuminating apparatus 1 cut along line A1-A1 in FIG. 1A. FIG. 2A is a plan view of illuminating apparatus 1 without holder fixing section 2. FIG. 2B is a cross-sectional view of illuminating apparatus 1 cut along line A2-A2 in FIG. 2A.

(Schematic Configuration of Illuminating Apparatus)

As illustrated in FIGS. 1A and 1B, illuminating apparatus 1 includes LED package 4 mounted on substrate 3, lens 5 through which light is transmitted from LED package 4, lens holder 6 supporting lens 5 over substrate 3 with lens 5 being positioned with respect to LED package 4, and holder fixing section 2 which fixes lens holder 6 to substrate 3 by pressing lens holder 6 thereto.

(Holder Fixing Section)

Figure 3:
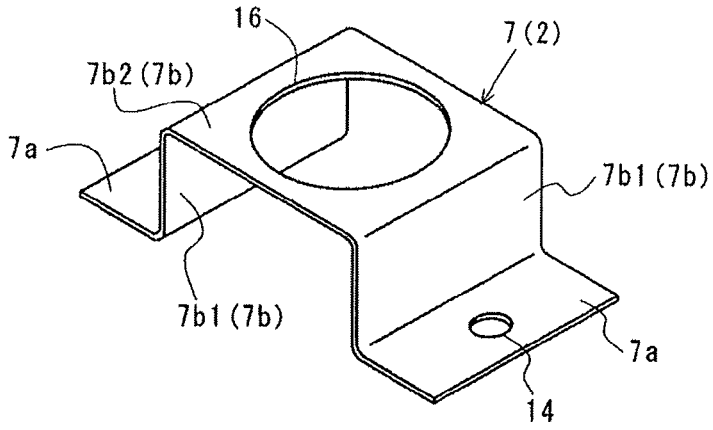
FIG. 3 is a perspective view illustrating a holder pressing plate of the holder fixing section configuring the illuminating apparatus of FIG. 1.
Figure 4B:
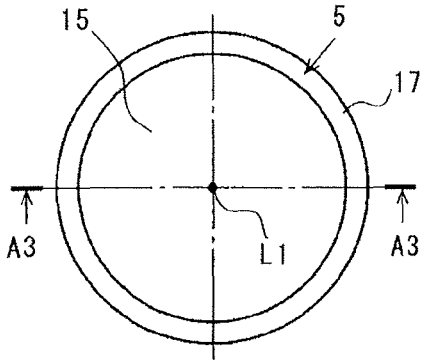
FIG. 4B is a plan view of the lens.
Figure 4A:
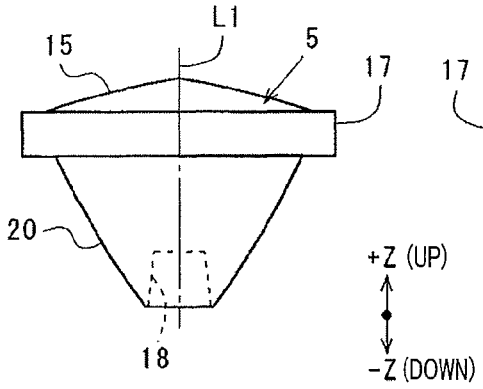
FIG. 4A is a front view of a lens configuring the illuminating apparatus of FIG. 1.
Figure 4D:
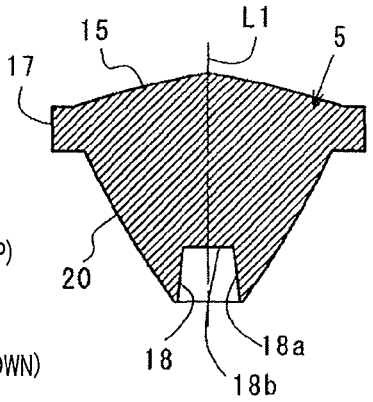
FIG. 4C is a bottom view of the lens and FIG. 4D is a cross-sectional view of the lens cut along line A3-A3 in FIG. 4B.
Figure 4C:
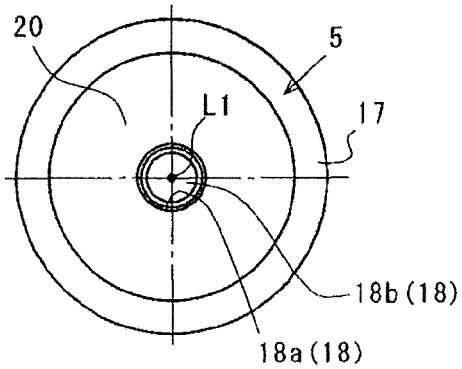
Figure 5A:
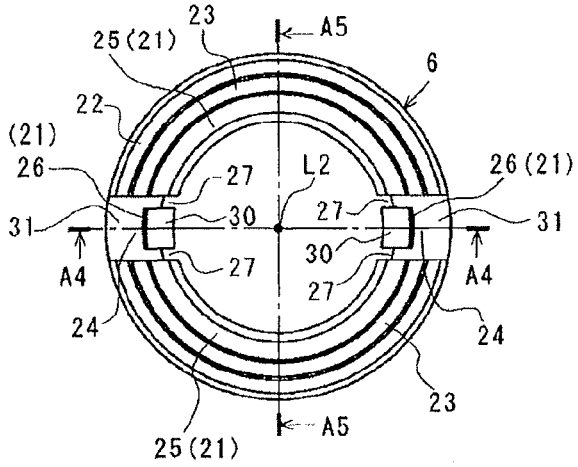
FIG. 5A is a plan view of a lens holder configuring the illuminating apparatus of FIG. 1.
Figure 5B:
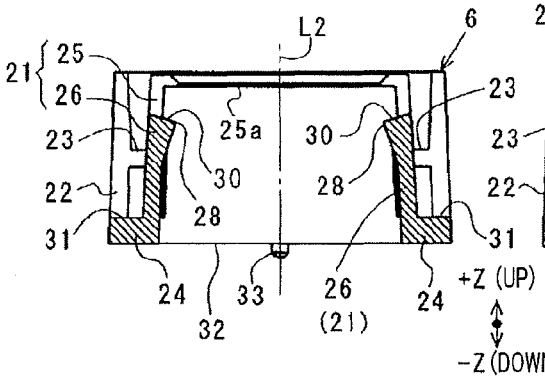
FIG. 5B is a cross-sectional view of the lens holder cut along line A4-A4 in FIG. 5A.
Figure 5C:
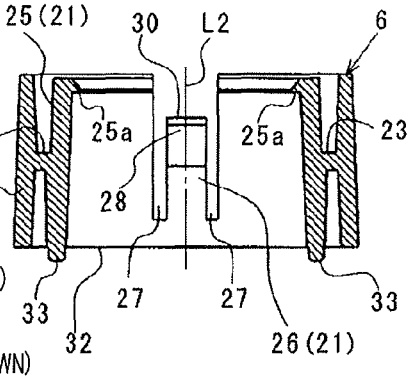
FIG. 5C is a cross-sectional view of the lens holder cut along line A5-A5 in FIG. 5A
Figure 5D:
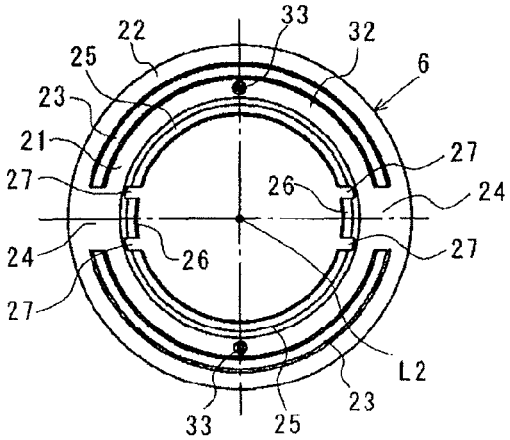
FIG. 5D is a bottom view of the lens holder.

As illustrated in FIGS. 1A, 1B and 3, holder fixing section 2 is configured of holder pressing plate 7 which is formed by pressing a metal plate (e.g.; a steel plate, a stainless steel plate), screw 10 and nut 11, which fasten substrate side fixing section 7*a* of holder pressing plate 7 to substrate 3 through washer 8.

In holder pressing plate 7, lens holder accommodation section 7*b*, which is extended upward (Z-axis direction in FIG. 1B) from substrate side fixing section 7*a*, is formed by being bent between substrate side fixing sections 7*a* and 7*a* of both ends. Lens holder accommodation section 7*b* of holder pressing plate 7 is configured of upright wall 7*b* 1 erected upward from substrate side fixing section 7*a* to generate gap 12 between a side surface of lens holder 6 and upright wall 7*b*1, and of ceiling wall 7*b*2 connecting a pair of upright walls 7*b*1 and 7*b*1 to abut an upper end of lens holder 6. Then, screw insertion hole 14 is formed in substrate side fixing section 7*a* of holder pressing plate 7 in accordance with the position of screw hole 13 of substrate 3. Furthermore, lens fitting hole 16 is formed in ceiling wall 7*b*2 of holder pressing plate 7 to expose emission surface 15 of lens 5 held in lens holder 6 to the outside.

Holder pressing plate 7 can accommodate lens holder 6 which holds lens 5 in an inner space of lens holder accommodation section 7*b* in a state where substrate side fixing section 7*a* is placed on substrate 3. In addition, in holder pressing plate 7, a boundary line (bending line) between substrate side fixing section 7*a* and lens holder accommodation section 7*b*, and a boundary line (bending line) between upright wall 7*b*1 and ceiling wall 7*b*2 are extended in a width direction of holder pressing plate 7 (Y-axis direction in FIG. 1A).

(Lens)

As illustrated in FIGS. 1A, 1B, 2A, 2B, and 4A to 4D, lens 5 has incidence surface 18 and total reflection surface 20 under ring-shaped flange 17 about lens central axis L1, and has emission surface 15 on an upper surface side of flange 17. For example, lens 5 is formed of a transparent resin material such as polymethyl methacrylate (PMMA), polycarbonate (PC) or epoxy resin (EP), or a transparent glass.

Incidence surface 18 is positioned to oppose LED package 4 mounted on substrate 3 and is a concave surface which is open to the lower part (LED package 4). Incidence surface 18 is formed about lens central axis L1. Then, incidence surface 18 is configured of first incidence surface 18*a* that is a tapered surface of which a diameter is decreased upward from the lower part and which is a rotationally symmetric surface about lens central axis L1, and circular-shaped second incidence surface 18*b* which is positioned in an upper end portion of first incidence surface 18*a* and is orthogonal to lens central axis L1.

Total reflection surface 20 is a tapered surface of which a diameter is increased upward from the lower part (the vicinity of an opening edge of first incidence surface 18*a*) and which is a rotationally symmetric surface about lens central axis L1. Total reflection surface 20 totally reflects the light from LED package 4 which has entered the inside of the lens from incidence surface 18, toward the side of emission surface 15.

Emission surface 15 is a conical surface converging on lens central axis L1 as it goes upward from the upper surface of flange 17. Emission surface 15 emits light that has entered inside of lens 5 from incidence surface 18 and directly reaching emission surface 15, and light reflected by total reflection surface 20 after entered inside of lens 5 from incidence surface 18 and reaching emission surface 15 to the outside of lens 5.

When optical axis L0 is defined as a direction where center light of a three-dimensional light flux emitted from LED package 4 propagate, lens 5 is supported on substrate 3 by lens holder 6 so that lens central axis L1 is concentric with optical axis LO.

(Lens Holder)

As illustrated in FIGS. 1A, 1B, 2A, 2B and 5A to 5D, lens holder 6 is configured of lens holding section 21 which elastically holds flange 17 of lens 5, section to be pressed 22 which is positioned further away from central axis L2 than lens holding section 21 and is positioned so as to surround lens holding section 21, and connecting sections 23 and 24 partially connecting lens holding section 21 and section to be pressed 22. Lens holder 6 is formed by injection molding and is integral with lens holding section 21, section to be pressed 22 and connecting sections 23 and 24, and the whole thereof is formed of an elastically deformable resin material.

Lens holding section 21 has a pair of first lens holding portions 25 and 25 pressing the upper surface of flange 17 of lens 5, and a pair of second lens holding portions 26 and 26 abutting the lower surface of flange 17 of lens 5. The pair of first lens holding portions 25 and 25, and the pair of second lens holding portions 26 and 26 are divided by slit 27 extending toward the vicinity of a lower end from an upper end of a cylindrical member about central axis L2 of lens holder 6, and are connected in the lower end portion. Then, the pair of first lens holding portions 25 and 25 is positioned so as to oppose each other about central axis L2. In addition, the pair of second lens holding portions 26 and 26 is positioned by being deviated 90° in a circumferential direction about central axis L0 with respect to the pair of first lens holding portions 25 and 25, and is positioned so as to oppose each other about central axis L0.

First lens holding portion 25 is configured such that hook 25*a* of the upper end thereof presses the upper surface of flange 17 of lens 5 along the circumferential direction thereof.

Second lens holding portion 26 is separated from first lens holding portion 25 by slit 27 except for the lower end portion thereof which is connected to first lens holding portion 25, and can be deformed independently of first lens holding portion 25. A width dimension of second lens holding portion 26 is smaller than that of first lens holding portion 25 in the circumferential direction and is easily deformed compared to first lens holding portion 25. In addition, operation projection 28 protruding inwards in the radial direction is formed on the upper end side of second lens holding portion 26. The upper end surface of second lens holding portion 26 is inclining surface 30 which is raised obliquely upward from an upper end edge of operation projection 28 as it separates from central axis L2 of lens holder 6.

When lens 5 is inserted into the inner space of lens holding section 21 from the bottom of lens holding section 21, the pair of second lens holding portions 26 and 26 is deformed in a direction (toward outside) in which the pair of second lens holding portions 26 and 26 is separated from central axis L2 by flange 17 of lens 5, and allows passing (moving upward) of flange 17 of lens 5. Then, when flange 17 of lens 5 has passed through to the upper side, the pair of second lens holding portions 26 and 26 is elastically restored, elastically presses inclining surface 30 to the outer peripheral rim of the lower surface side of flange 17 of lens 5, and presses flange 17 of lens 5 to the lower surface of hook 25*a* of first lens holding portion 25. Therefore, flange 17 of lens 5 is elastically held by the pair of first lens holding portions 25 and 25 and the pair of second lens holding portions 26 and 26.

Section to be pressed 22 is positioned on the outside of lens holding section 21 so as to be concentric with lens holding section 21. Section to be pressed 22 has a shape dividing a cylindrical member in two in the circumferential direction by notch section 31 formed corresponding to second lens holding portion 26 except for the lower end portion. Furthermore, a dimension (a dimension in a Z-axis direction) of section to be pressed 22 in the height direction thereof is greater than a dimension of lens holding section 21 in the height direction thereof. That is, the upper end of section to be pressed 22 is positioned above the upper end of lens holding section 21. As a result, when lens holder 6 is fixed to substrate 3 using holder fixing section 2, section to be pressed 22 is pressed toward substrate 3 by holder pressing plate 7; however, lens holding section 21 does not abut holder pressing plate 7. Thus, a force of holder fixing section 2 does not directly act on lens holding section 21.

The middle portion of section to be pressed 22 in the height direction is partially connected to first lens holding portion 25 of lens holding section 21 by first connecting section 23. In addition, the lower end portion of section to be pressed 22 is partially connected to lens holding section 21 except for first lens holding portion 25 by second connecting section 24. The thicknesses of first connecting section 23 and second connecting section 24 are set to be substantially the same as that of section to be pressed 22.

As described above, it is possible to prevent deformation of section to be pressed 22 from affecting lens holding section 21 by partially connecting lens holding section 21 and section to be pressed 22 using first connecting section 23 and second connecting section 24, even though section to be pressed 22 is deformed with a fastening force of holder fixing section 2 when section to be pressed 22 is pressed toward substrate 3 by holder fixing section 2. Therefore, lens holding section 21 can accurately hold lens 5 on substrate 3.

In such lens holder 6, it is possible to suppress deformation of lens holding section 21, even though the gap between the lower end of lens 5 and LED package 4 is set to be very small in order to increase use efficiency of the light from LED package 4, and section to be pressed 22 is deformed by holder fixing section 2. Thus, lens holding section 21 can support lens 5 with high accuracy and lens 5 does not abut against LED package 4.

In addition, a pair of positioning projections 33 and 33 are formed on back surface 32 of lens holder 6. Central axis L2 of lens holder 6 can be aligned with optical axis LO of LED package 4 by placing back surface 32 on substrate 3, in a state where the pair of positioning projections 33 and 33 are engaged with a pair of positioning holes (not illustrated) formed in substrate 3. As a result, central axis L1 of lens 5 held by lens holding section 21 of lens holder 6 can be aligned with optical axis L0 of LED package 4.

(Advantage of Embodiment 1)

In illuminating apparatus 1 according to the embodiment, since the fastening force of holder fixing section 2 does not directly act on lens holding section 21 which holds lens 5, it is possible to suppress deformation of lens 5 by lens holder 6. Therefore, in illuminating apparatus 1 according to the embodiment, decrease in optical performance caused by the fastening force of holder fixing section 2 does not occur.

In addition, in illuminating apparatus 1 according to the embodiment, it is possible to prevent the deformation of section to be pressed 22 of lens holder 6 on which the fastening force of holder fixing section 2 acts from adversely affecting support accuracy of lens holding section 21 of lens holder 6 to lens 5. Thus, in illuminating apparatus 1 according to the embodiment, it is possible to suppress occurrence of deviation in the positional relationship from the designed positional relationship between lens 5 and LED package 4.

Furthermore, in illuminating apparatus 1 according to the embodiment, even though the gap between lens 5 and LED package 4 is designed to be very small in order to increase the light use efficiency from LED package 4, it is possible to prevent lens holding section 21 of lens holder 6 elastically supporting lens 5 from being deformed by the fastening force of holder fixing section 2, and it is possible to support lens 5 by lens holding section 21 of lens holder 6 with high accuracy. In illuminating apparatus 1 according to the embodiment, since the gap between lens 5 and LED package 4 is reliably maintained, each of lens 5 and LED package 4 is not damaged by coming into contact with the other.

In addition, in illuminating apparatus 1 according to the embodiment, the gap between lens 5 and LED package 4 is reliably maintained even though illuminating apparatus 1 is used in a portion on which vibration of a vehicle or the like acts. Thus, it is possible to prevent occurrence of noise due to the vibration without minute collisions between lens 5 and LED package 4 due to the vibration, or friction between lens 5 and LED package 4 due to the vibration.

Embodiment 2

Figure 6A:
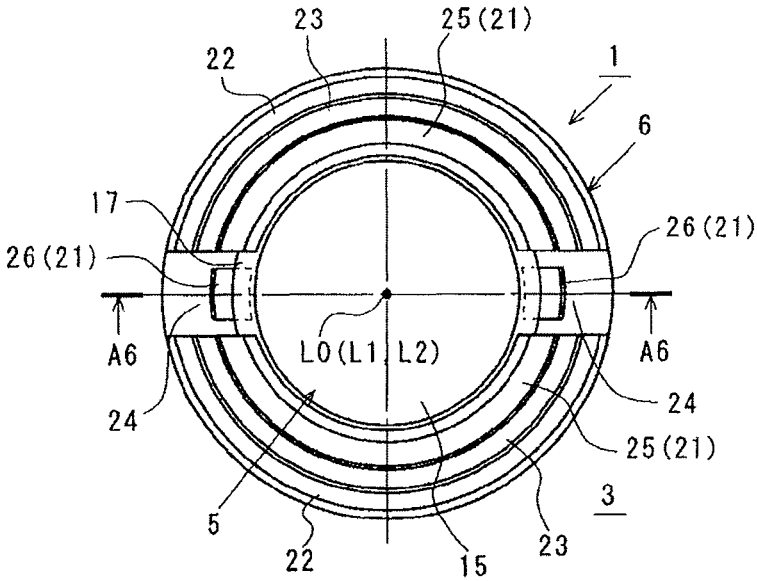
FIG. 6A is a plan view illustrating an illuminating apparatus according to Embodiment 2 of the present invention without a holder fixing section and FIG. 6B is a cross-sectional view cut along line A6-A6 in FIG. 6A.
Figure 6B:
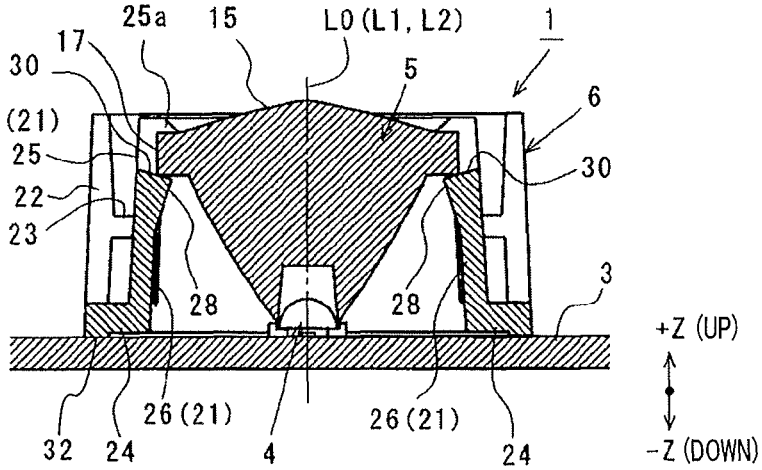

FIGS. 6A and 6B illustrate illuminating apparatus 1 according to Embodiment 2 of the present invention without holder fixing section 2. FIGS. 6A and 6B correspond to FIG. 2A and 2B, respectively. In addition, in illuminating apparatus 1 illustrated in FIGS. 6A and 6B, the same symbols as those of the elements of illuminating apparatus 1 illustrated in FIGS. 2A and 2B are given to elements corresponding to illuminating apparatus 1 illustrated in FIGS. 2A and 2B, and description overlapping with the description of illuminating apparatus 1 according to Embodiment 1 is omitted.

In illuminating apparatus 1 according to the embodiment, lens holding section 21 and second connecting section 24 are positioned by being deviated upward (+Z-axis direction) from back surface 32 of section to be pressed 22. Thus, when lens holder 6 is placed on substrate 3, a gap is generated between lens holding section 21 and second connecting section 24, and substrate 3.

In illuminating apparatus 1 according to the embodiment, since vibration on the side of substrate 3 is not directly transmitted to lens holding section 21 which elastically holds lens 5, it is possible to prevent vibration of lens 5 due to the vibration such as the vibration of the vehicle.

In addition, in illuminating apparatus 1 according to the embodiment, it is possible to obtain the same advantage as in illuminating apparatus 1 according to Embodiment 1.

Embodiment 3

Figure 7A:
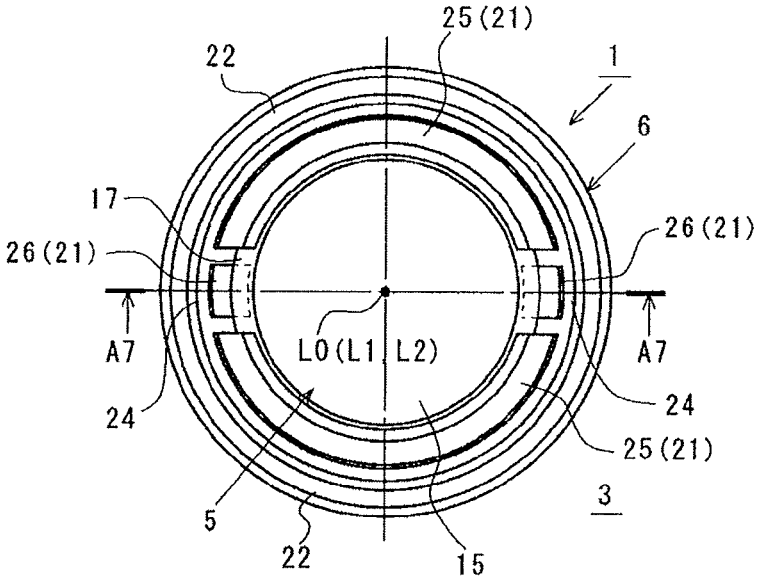
FIG. 7A is a plan view illustrating an illuminating apparatus according to Embodiment 3 of the present invention without a holder fixing section and FIG. 7B is a cross-sectional view cut along line A7-A7 in FIG. 7A.
Figure 7B:
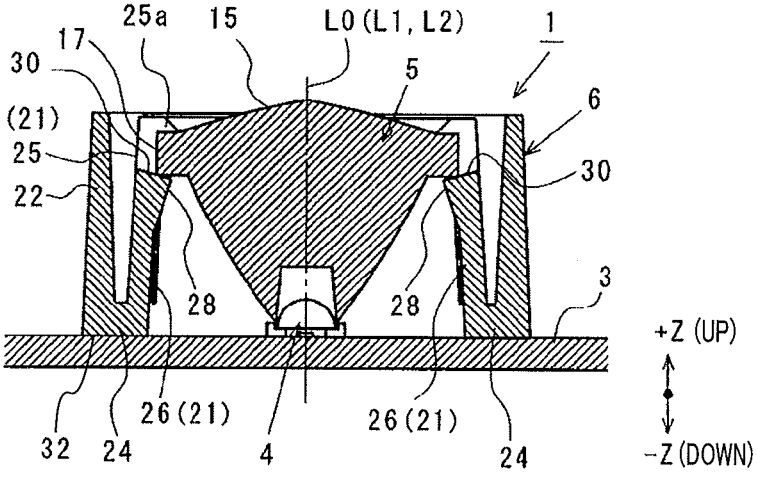

FIGS. 7A and 7B illustrate illuminating apparatus 1 according to Embodiment 3 of the present invention without holder fixing section 2. FIGS. 7A and 7B correspond to FIGS. 2A and 2B, respectively. In addition, in illuminating apparatus 1 illustrated in FIGS. 7A and 7B, the same symbols as those of the elements of the illuminating apparatus 1 illustrated in FIGS. 2A and 2B are given to elements corresponding to illuminating apparatus 1 illustrated in FIGS. 2A and 2B, and description overlapping with the description of illuminating apparatus 1 according to Embodiment 1 is omitted.

In illuminating apparatus 1 according to the embodiment, first connecting section 23 partially connecting lens holding section 21 and section to be pressed 22 of lens holder 6 are omitted, and lens holding section 21 and section to be pressed 22 are partially connected to each other by second connecting section 24. In addition, in the embodiment, second connecting section 24 integrally connects a whole circumference of the lower end portion of lens holding section 21 and the lower end portion of section to be pressed 22 to each other.

In illuminating apparatus 1 of the embodiment, it is possible to obtain the same advantage as in illuminating apparatus 1 according to Embodiment 1.

Embodiment 4

Figure 8A:
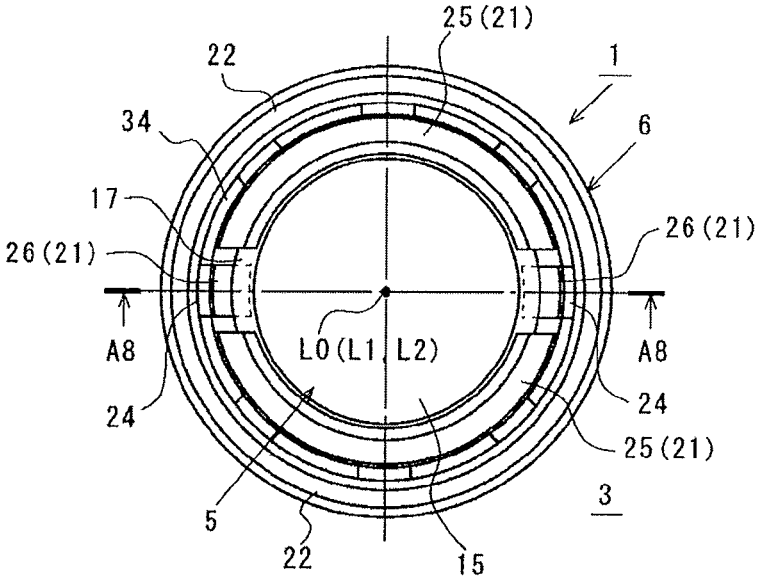
FIG. 8A is a plan view illustrating an illuminating apparatus according to Embodiment 4 of the present invention without a holder fixing section and FIG. 8B is a cross-sectional view cut along line A8-A8 in FIG. 8A, corresponding to FIG. 2B.
Figure 8B:
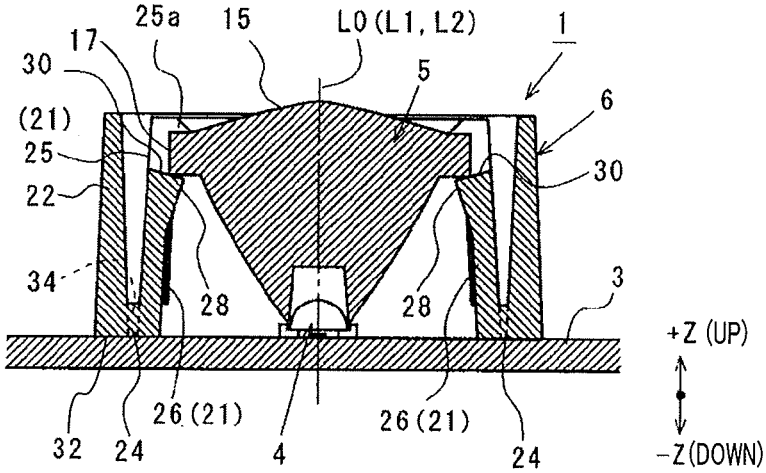

FIGS. 8A and 8B illustrate illuminating apparatus 1 according to Embodiment 4 of the present invention without holder fixing section 2. FIGS. 8A and 8B correspond to FIGS. 2A and 2B, respectively. In addition, since illuminating apparatus 1 illustrated in FIGS. 8A and 8B is a modification example of illuminating apparatus 1 illustrated in FIGS. 7A and 7B, the same symbols as those of the elements of illuminating apparatus 1 illustrated in FIGS. 2A, 2B, 7A and 7B are given to elements corresponding to illuminating apparatus 1 illustrated in FIGS. 2A, 2B, 7A and 7B, and description overlapping with the description of illuminating apparatus 1 illustrated in FIGS. 2A, 2B, 7A and. 7B is omitted.

In illuminating apparatus 1 according to the embodiment, a plurality of bored holes 34 passing through second connecting section 24 of lens holder 6 in the thickness direction (the Z-axis direction) thereof are formed at equal intervals along the circumferential direction of second connecting section 24.

In illuminating apparatus 1 according to the embodiment, it is possible to reduce the material of lens holder 6 by the amount of bored holes 34 and it is possible to reduce the overall weight thereof.

In illuminating apparatus 1 of the embodiment, it is possible to obtain the same advantage as in illuminating apparatus 1 according to Embodiment 1.

Embodiment 5

Figure 9A:
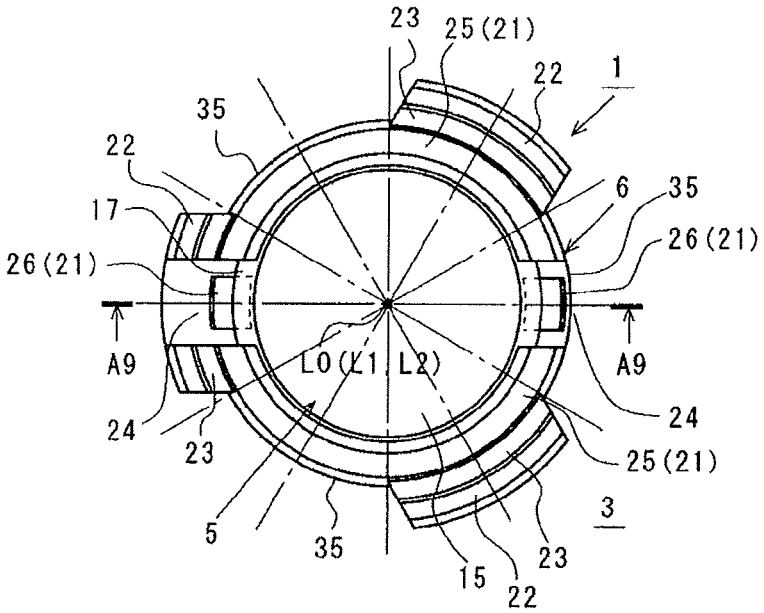
FIG. 9A illustrates an illuminating apparatus according to Embodiment 5 of the present invention without a holder fixing section and FIG. 9B is a cross-sectional view cut along line A9-A9 in FIG. 9A.
Figure 9B:
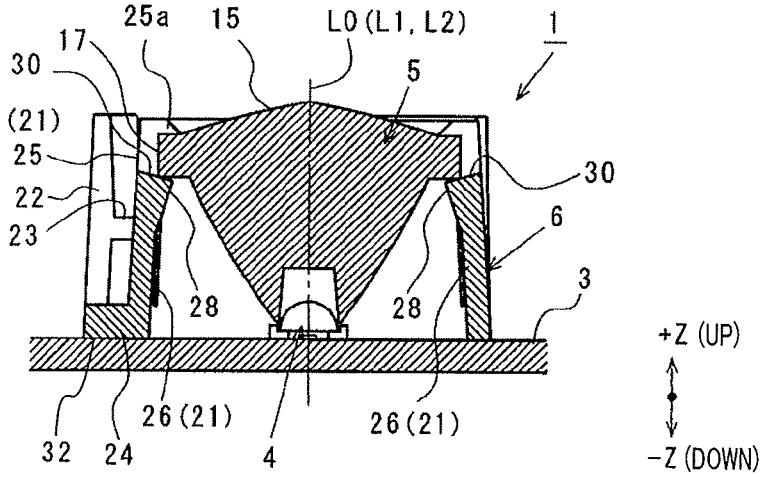

FIGS. 9A and 9B illustrate illuminating apparatus 1 according to Embodiment 5 of the present invention without holder fixing section 2. FIGS. 9A and 9B correspond to FIGS. 2A and 2B, respectively. In addition, in illuminating apparatus 1 illustrated in FIGS. 9A and 9B, the same symbols as those of the elements of illuminating apparatus 1 illustrated in FIGS. 2A and 2B are given to elements corresponding to illuminating apparatus 1 illustrated in FIGS. 2A and 2B, and description overlapping with the description of illuminating apparatus 1 according to Embodiment 1 is omitted.

In illuminating apparatus 1 according to the embodiment, first connecting section 23 and section to be pressed 22 are divided by three notched sections 35 which are disposed at equal intervals along the circumferential direction thereof.

In illuminating apparatus 1 according to the embodiment, it is possible to reduce the material of lens holder 6 by the amount in notched sections 35 and it is possible to reduce the overall weight thereof.

In illuminating apparatus 1 of the embodiment, it is possible to obtain the same advantage as in the illuminating apparatus 1 according to Embodiment 1.

Embodiment 6

Figure 10A:
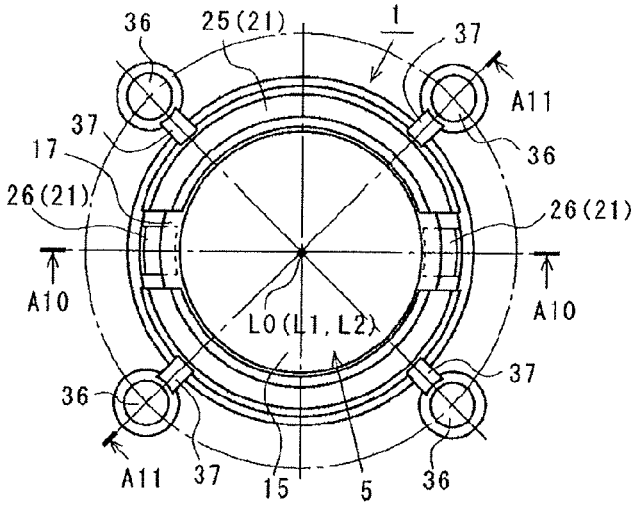
FIG. 10A illustrates an illuminating apparatus according to Embodiment 6 of the present invention without a holder fixing section.
Figure 10B:
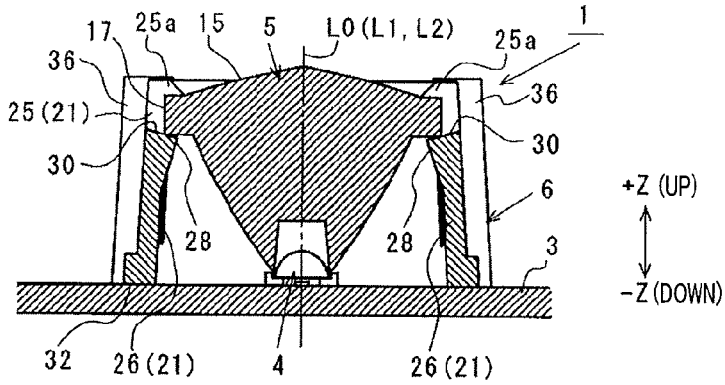
FIG. 10B is a cross-sectional view cut along line A10-A10 in FIG. 10A
Figure 10C:
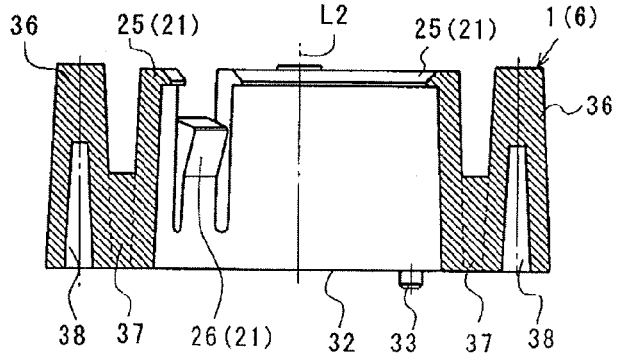
FIG. 10C is a cross-sectional view of the lens holder cut along line A11-A11 in FIG. 10A.
Figure 11:
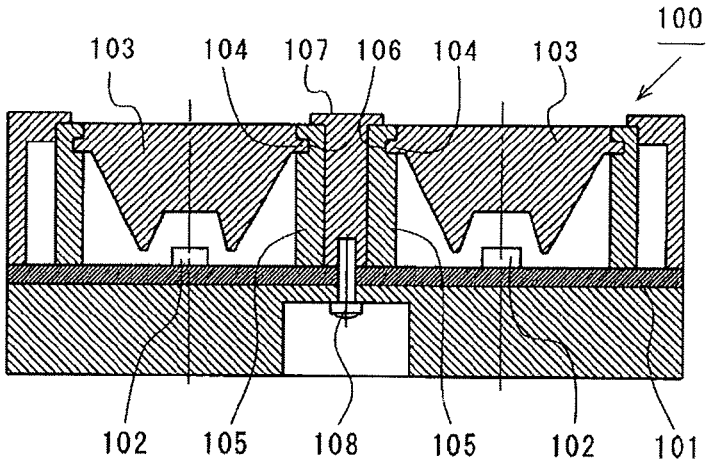
FIG. 11 is a longitudinal cross-sectional view illustrating an illuminating apparatus of the related art.

FIGS. 10A to 10B illustrate illuminating apparatus 1 according to Embodiment 6 of the present invention without holder fixing section 2. FIGS. 10A and 10B correspond to FIGS. 2A and 2B, respectively. In addition, FIG. 10C is a cross-sectional view of lens holder 6 cut along line A11-A11 in FIG. 10A. In FIG. 10C, lens 5 is omitted. In illuminating apparatus 1 illustrated in FIG. 10A to 10C, the same symbols as those of the elements of illuminating apparatus 1 illustrated in FIGS. 2A and 2B are given to elements corresponding to illuminating apparatus 1 illustrated in FIGS. 2A and 2B, and description overlapping with the description of illuminating apparatus 1 according to Embodiment 1 is omitted.

In illuminating apparatus 1 according to the embodiment, four truncated cone-shaped sections to be pressed 36 are included instead of section to be pressed 22 of illuminating apparatus 1 according to Embodiment 1. Four sections to be pressed 36 are disposed at equal intervals along the circumference of lens holding section 21 and are partially connected to the outside surface of lens holding section 21 by connecting section 37. Then, bored holes 38 open toward back surface 32 are formed in sections to be pressed 36.

In illuminating apparatus 1 according to the embodiment, it is possible to reduce the material of lens holder 6 and it is possible to reduce the overall weight thereof.

In illuminating apparatus 1 of the embodiment, it is possible to obtain the same advantage as in the illuminating apparatus 1 according to Embodiment 1.

Other Modification Examples

The configuration (the configuration in which the gap is generated between lens holding section 21, second connecting section 24 and substrate 3) of illuminating apparatus 1 according to Embodiment 2 illustrated in FIGS. 6A and 6B can be applied to lens holding section 21 and second connecting section 24 of illuminating apparatus 1 according to Embodiments 3 to 5, and can be applied to lens holding section 21 and connecting section 37 of illuminating apparatus 1 according to Embodiment 6.

Furthermore, the configuration (the configuration in which bored holes 34 are formed in second connecting section 24) of illuminating apparatus 1 according to Embodiment 4 illustrated in FIGS. 8A and 8B can be applied to first connecting section 23 of illuminating apparatus 1 according to Embodiments 1 and 2, and of illuminating apparatus 1 according to Embodiment 5.

Furthermore, in each embodiment described above, an example is illustrated in which the flange of the lens is elastically held by the lens holding section of the lens holder. However, the lens holding section is not limited to that in the embodiment. For example, the lens may be held by a screw-type fitting between the lens holding section and the flange of the lens, and the lens may be held by adhesive between the lens holding section and the flange of the lens.

Furthermore, in each embodiment described above, an example is illustrated in which one lens is held by one lens holder and the lens holder is fixed by one holder pressing plate. However, it is not necessary to adapt one holder pressing plate to one lens. For example, a plurality of lens fitting holes are formed in the ceiling wall of the holder pressing plate and a plurality of lenses and lens holders may be fixed by one holder pressing plate.

This application claims priority based on Japanese patent Application No. 2011-154354, filed on Jul. 12, 2011, the entire contents of which including specification and the drawings are incorporated herein by reference.

INDUSTRIAL APPLICABILITY

The illuminating apparatus according to the invention can be used as a headlight or a tail lamp of the vehicle by attaching multiple pieces to the vehicle body or the like.

REFERENCE SIGNS LIST

1 Illuminating apparatus
2 Holder fixing section
3 Substrate
4 LED package
5 Lens
6 Lens holder
17 Flange
21 Lens holding section
22, 36 Section to be pressed
23, 24, 37 Connecting section
L0 Optical axis
L1 Lens central axis

The invention claimed is:

1. An illuminating apparatus comprising:
an LED package mounted on a substrate;
a lens which is disposed so as to oppose the LED package and through which light from the LED package is transmitted;
a lens holder that supports the lens over the substrate with the lens being positioned with respect to the LED package; and
a holder fixing section that fixes the lens holder to the substrate by pressing the lens holder thereto,
wherein the lens:
has a ring-shaped flange about a lens central axis along an outer periphery thereof; and
is supported by the lens holder so that the lens central axis is concentric with an optical axis, the optical axis defined as a direction where center light of a three-dimensional light flux emitted from the LED package propagates, and
wherein the lens holder:
has a lens holding section supporting the flange of the lens, sections to be pressed being positioned further away from the lens central axis than the lens holding section, being positioned so as to surround the lens holding section and being pressed toward the substrate by the holder fixing section, and connecting sections partially connecting the lens holding section and the sections to be pressed;
is configured such that heights of the sections to be pressed from the substrate are greater than a height of the lens holding section from the substrate, and the lens holding section does not come into contact with the holder fixing section; and
is configured in such a manner that when the sections to be pressed are pressed by the holder fixing section, the lens holding section and a part of the sections to be pressed are connected to each other by the connecting sections so that deformation of the sections to be pressed does not affect the lens holding section.

* * * * *